US009387356B2

(12) United States Patent
Jaidar

(10) Patent No.: US 9,387,356 B2
(45) Date of Patent: Jul. 12, 2016

(54) MULTI-EXERCISE DEVICE

(76) Inventor: Jorge Jaidar, Calabasas, CA (US)

( * ) Notice: Subject to any disclaimer, the term of this patent is extended or adjusted under 35 U.S.C. 154(b) by 346 days.

(21) Appl. No.: 13/543,726

(22) Filed: Jul. 6, 2012

(65) Prior Publication Data

US 2014/0011643 A1 Jan. 9, 2014

(51) Int. Cl.

| | |
|---|---|
| ***A63B 21/072*** | (2006.01) |
| ***A63B 21/06*** | (2006.01) |
| ***A63B 15/00*** | (2006.01) |
| *A63B 21/00* | (2006.01) |
| *A63B 21/075* | (2006.01) |

(52) U.S. Cl.

CPC ..... *A63B 21/072* (2013.01); *A63B 15/00* (2013.01); *A63B 21/0004* (2013.01); *A63B 21/0602* (2013.01); *A63B 21/0603* (2013.01); *A63B 21/0605* (2013.01); *A63B 21/075* (2013.01)

(58) Field of Classification Search

CPC .. A63B 21/004; A63B 21/1446; A63B 21/06; A63B 21/065; A63B 21/1449; A63B 21/072; A63B 21/00065; A63B 21/00079; A63B 21/0013; A63B 21/00138; A63B 21/0004; A63B 21/0602; A63B 21/0603; A63B 21/0605; A63B 21/075; A63B 15/00

USPC ..... 482/92, 93, 105, 109

See application file for complete search history.

(56) References Cited

U.S. PATENT DOCUMENTS

| | | | | |
|---|---|---|---|---|
| 1,005,791 | A * | 10/1911 | Angell | 482/93 |
| 6,149,555 | A * | 11/2000 | Kinback | 482/93 |
| D615,137 | S * | 5/2010 | Ivanov | D21/680 |
| D656,567 | S * | 3/2012 | Ivanov | D21/680 |
| 8,276,351 | B1 * | 10/2012 | Henkin | 53/469 |
| 2005/0187075 | A1 * | 8/2005 | Bellamy | 482/93 |
| 2006/0229173 | A1 * | 10/2006 | Foley | 482/105 |
| 2007/0129220 | A1 * | 6/2007 | Bardha | 482/82 |
| 2007/0287600 | A1 * | 12/2007 | Prenatt | 482/41 |
| 2008/0023355 | A1 * | 1/2008 | Reynolds | 206/315.1 |
| 2009/0163329 | A1 * | 6/2009 | Pearce | 482/93 |
| 2010/0048363 | A1 * | 2/2010 | Gilberti et al. | 482/105 |
| 2010/0056347 | A1 * | 3/2010 | Summers | 482/105 |
| 2011/0183819 | A1 * | 7/2011 | Pharoe | 482/105 |
| 2011/0287904 | A1 * | 11/2011 | Morris | 482/93 |
| 2011/0319235 | A1 * | 12/2011 | Garrett | 482/105 |
| 2012/0058863 | A1 * | 3/2012 | Brizard et al. | 482/93 |
| 2012/0149536 | A1 * | 6/2012 | Trimble et al. | 482/93 |
| 2013/0017933 | A1 * | 1/2013 | Foster | 482/105 |
| 2013/0157815 | A1 * | 6/2013 | Reynolds et al. | 482/93 |

OTHER PUBLICATIONS

Brown, Kyle. "The Bulgarian Bag: Extreme Training for the Next Fitness Generation." NCSA's Performance Training Journal 8.3 (2009): 11-12. Web. Jun. 11, 2014. <www.nsca-lift.org>.*

* cited by examiner

*Primary Examiner* — Loan H Thanh
*Assistant Examiner* — Sundhara Ganesan
(74) *Attorney, Agent, or Firm* — Cotman IP Law Group, PLC

(57) ABSTRACT

A multi-exercise device including a device body including a first side and a second side disposed on opposite sides of the device body, at least one weight receiving area disposed on an interior of the device body, where the at least one weight receiving area is configured to secure at least one weight inside of the device body, at least one side handle including a first end and a second end, where the at least one side handle is coupled with the first side of the device body near the first end and the second end, two or more side grips disposed on the at least one side handle, and two extending handles, each including a proximal end and a distal end, where the two extending handles are coupled with the second side of the device body at the proximal end.

19 Claims, 10 Drawing Sheets

MULTI-EXERCISE DEVICE

BACKGROUND OF THE INVENTION

1. Field of the Invention

Embodiments of the invention described herein pertain to the field of fitness. More particularly, but not by way of limitation, one or more embodiments of the invention enable a multi-exercise device.

2. Description of the Related Art

Devices for exercise and physical fitness are known in the art. Many home systems are provided that offer the ability to perform multiple exercises on a single piece of equipment. Many of these exercises systems require a large amount of floor space to use and store.

Exercises may also be performed using a variety of free weights, bars, bands, and kettle bells. Some free weight devices include handles to grab onto the individual weight. Although space is reduced, these items do not provide the simplicity and the portability of a single device.

To overcome the problems and limitations described above there is a need for a multi-exercise device.

BRIEF SUMMARY OF THE INVENTION

One or more embodiments of the multi-exercise device described herein are directed to a multi-exercise device. The multi-exercise device includes a device body with a first side and a second side disposed on opposite sides of the device body. In one or more embodiments, the first side of the device body is longer than the second side of the device body. The device body may be filled with a padding material. In one or more embodiments, the padding material is a fibrous padding material.

The multi-exercise device further includes at least one weight receiving area disposed on an interior of the device body. The at least one weight receiving area is configured to secure at least one weight inside of the device body. In one or more embodiments, the multi-exercise device, further includes the at least one weight. The at least one weight may include sand.

The multi-exercise device further includes at least one side handle coupled with the first side of the device body. In one or more embodiments, the at least one side handle includes two outer side handles. The at least one side handle may further include a center side handle located between the two outer side handles.

The multi-exercise device further includes two or more side grips disposed on the at least one side handle. The at least one side handle and the two or more hand grips may be positioned in a row along a length of the first side of the device body. In one or more embodiments, the at least one side handle includes a single side handle including multiple hand grip positions, where the multiple hand grip positions include the two or more hand grips.

The multi-exercise device further includes two extending handles, each including a proximal end and a distal end. The two extending handles are coupled with the second side of the device body at the proximal end. In one or more embodiments, the two extending handles are disposed near opposite ends of the second side of the device body. The distal end of the two extending handles may include a widened portion. In one or more embodiments, the two extending handles extend from the second side by at least about 8 inches.

In one or more embodiments, the multi-exercise device further includes two security loops coupled with the device body. Each of the two security loops may be positioned adjacent to one of the two extending handles.

In one or more embodiments, the device body includes a sealable opening. The sealable opening may include a lacing system.

One or more embodiments of the multi-exercise device described herein are directed to a method of using the multi-exercise device. The method includes grabbing one of the two extending handles with a left hand, grabbing a remaining extending handle with a right hand, raising a left arm and a right arm above shoulder level, and moving the left arm and the right arm in a circular path to swing the device body in a circular path.

One or more embodiments of the multi-exercise device described herein are directed to a method of using the multi-exercise device. The method includes placing the device body on a portion of a body including at least one foot, where the at least one weight is disposed within the device body, and performing at least one strength training exercise.

One or more embodiments of the multi-exercise device described herein are directed to a method of using the multi-exercise device. The method includes grabbing at least one of the at least one side handle with at least one hand, and performing at least one weight-training exercise.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

A MULTI-EXERCISE DEVICE will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary kill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
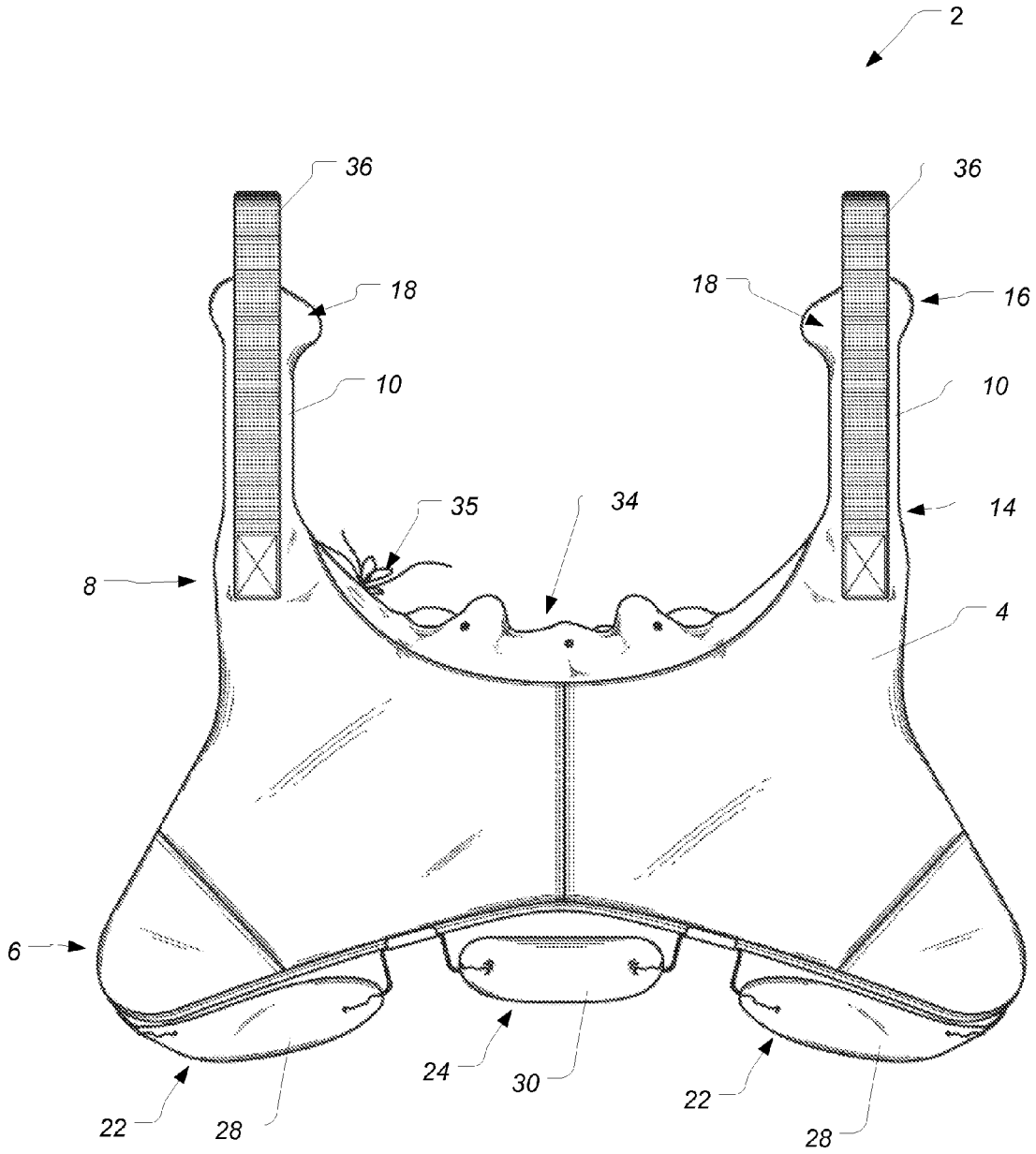
FIG. 1 illustrates a front view of an exemplary multi-exercise device in accordance with one or more embodiments of a multi-exercise device.

FIG. 1 illustrates a front view of an exemplary multi-exercise device in accordance with one or more embodiments of a multi-exercise device. Multi-exercise device 2 includes device body 4. In one or more embodiments, device body 4 comprises a shell filled with a padding material. The shell may be made of rubber, leather, vinyl, canvas, nylon, any other fabric, or any other suitable material. The padding material may be a fibrous padding material, including but not limited to cotton, synthetic fibers, shredded fabric, shredded material, foam, styrofoam, or any other suitable padding material.

Device body 4 has a first side 6 and a second side 8 disposed on opposite sides of device body 4. In one or more embodiments, first side 6 is longer than second side 8.

At least one side handle 22-24 is coupled with first side 6 of device body 4. One or more side grips 28-30 are disposed on each side handles 22-24. Side handle 22 may be coupled with device body 4 at one or more points by sewing, stapling, mounting, heat, adhesive, or any other method. Side handles 22-24 may be directly built into device body 4 on first side 6. In one or more embodiments, two of side handles 22-24 are coupled with first side 6 of device body 4 at or near each end of first side 6. The at least one side grip may be any surface suitable for grabbing with a hand. In one or more embodiments, one or more side grip is optionally padded, contoured, molded, or otherwise tailored for hand placement. Alternatively, any surface of side handles 22-24 suitable for a hand grip may function as a side grip.

Figure 7A:
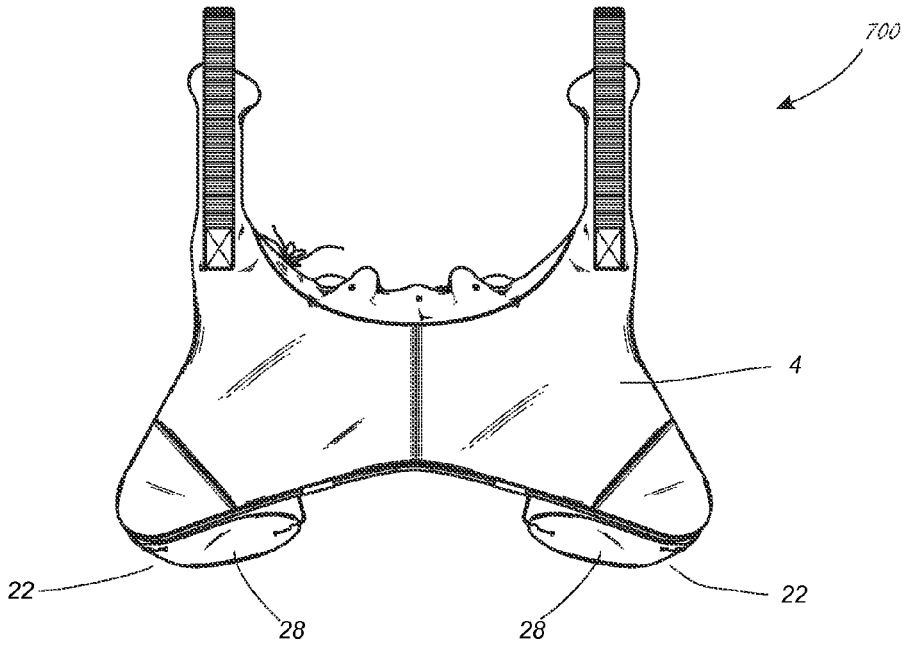
FIGS. 7A-7B illustrate exemplary multi-exercise devices in accordance with one or more embodiments of a multi-exercise device.
Figure 7B:
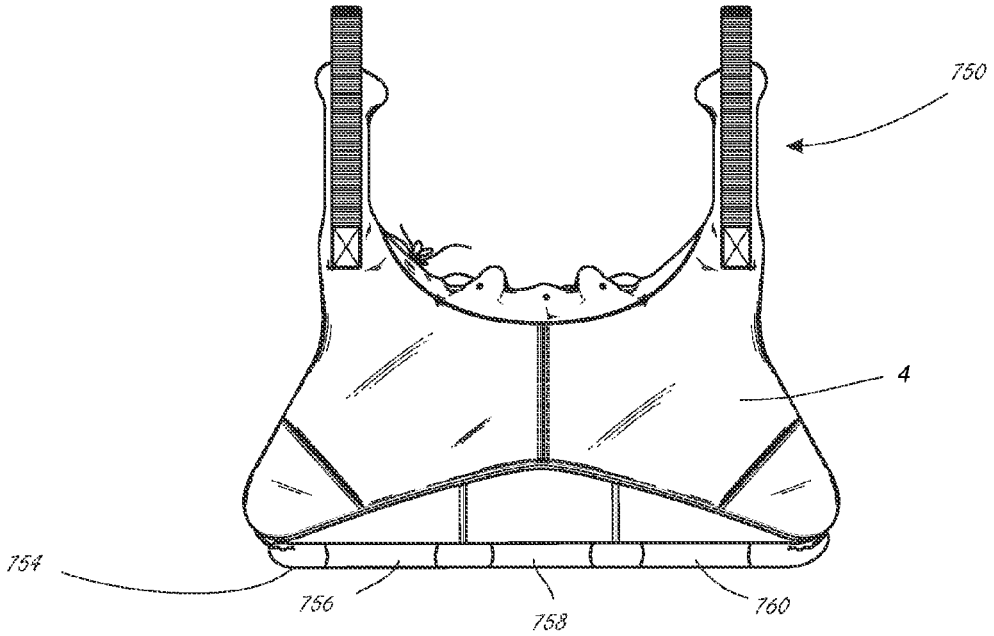

On multi-exercise device 2, one side grip 28-30 is disposed on each side handle 22-24. Multi-exercise device 2 is an embodiment with three side handles 22-24, with one side grip 28-30 disposed on each side handle 22-24. The side handles of multi-exercise device 2 include two outer side handles 22 and one center side handle 24. In one or more embodiments, multiple side grips may be disposed on a single side handle. FIGS. 7A-7B illustrates exemplary multi-exercise devices in accordance with one or more embodiments of a multi-exercise device. FIG. 7A illustrates exemplary multi-exercise device 700. Multi-exercise device 700 includes two outer side handles 22 coupled with device body 4. A side grip 28 is disposed on each of side handle 22. FIG. 7B illustrates exemplary multi-exercise device 750. Multi handles 10 extend from device body by between about 6 inches to about 18 -exercise device 750 includes one side handle 754 coupled with device body 4. A plurality of side grips 756-760 is disposed on side handle 754.

Two extending handles 10 are coupled with second side 8 of device body 4. In one or more embodiments, the extending handles 10 are disposed near opposite ends of second side 8 of device body 4. Extending handles 10 each comprise proximal end 14 and distal end 16. Extending handles 10 are coupled with device body 4 at proximal end 14 of each extending handle 10. Multi-exercise device may be held by one or more hands placed on extending handles 10. Extending handles 10 may extend from device body 2 by at least about 4 inches, or by at least about 8 inches. In one or more embodiments, extending inches, or between about 8 inches to about 16 inches.

Extending handles 10 may be filled with padding material. The padding material may be a fibrous padding material, including but not limited to cotton, synthetic fibers, shredded fabric, shredded material, foam, styrofoam, or any other suitable padding material. Extending handles 10 may be coupled with device body 4 at one or more points by sewing, stapling, mounting, heat, adhesive, or any other method. In one or more embodiments, extending handles 10 are built into a shell forming device body 4. In one or more embodiments, extending handles 10 are coupled with second side 8 of device body 4 at or near each end of second side 8.

In one or more embodiments, extending handles 10 comprise a widened portion 18 at distal end. Widened portion 18 may be configured to keep a hand placed on one of extending handles 10 from slipping off the handle 10, such as when a force is applied. In one or more embodiments, widened portion 18 prevents slipping when a centrifugal force is generated by swinging multi-exercise device 2.

Multi-exercise device 2 may further include at least one security loop 36 coupled with device body 2. Each of the at least one security loop 36 is configured to wrap around a hand, arm or wrist to further secure multi-exercise device 2 during use. Security loops 36 may be coupled with device body at one or more points by sewing, stapling, mounting, heat, adhesive, or any other method. Security loops 36 may comprise straps, rope, cable, elastic, any other suitable component and/or any combination thereof. In one or more embodiments, security loops 36 are disposed near one or more extending handle and/or side handle. Multi-exercise device 2 has a security loop 36 coupled with device body 2 near the proximal end of each extending handle 10.

In one or more embodiments, multi-exercise device 2 includes at least one weight disposed inside device body 4. Alternatively, a removable weight, e.g. 40 and 42, may be disposed inside multi-exercise device 2. Device body 4 may include at least one weight receiving area within sealable opening 34 configured to secure the at least one weight inside of device body 4. In one or more embodiments, a weight is simply placed inside of device body 4. The weight may be held in place by padding material 44. In one or more embodiments, one or more straps, pockets, clasps, bands, fasteners, or any other securing device is used to further secure the at least one weight inside of device body 4. In one or more embodiments, the weight includes a covering filled with a weighted material. The weight may include steel, lead, tungsten, bismuth, alloy, iron, sand, water, liquid, shot, pellets, metal, or any other material suitable for a weight.

In one or more embodiments, device body 4 further includes sealable opening 34. Sealable opening 34 may include a fastener 35 for securing the opening. Fastener 35 may be a zipper, a lacing system, buttons, clasps, connectors, or any other method suitable for providing a sealable opening. In one or more embodiments, a user may open sealable opening 34 to add, remove and/or modify the amount of weights placed in device body 4.

In one or more embodiments, device body 4 is configured to receive between about 5 pounds to about 50 pounds of weights. Device body 4 may be configured to receive between about 10 pounds to about 35 pounds of weights. In one or more embodiments, device body 4 is configured to receive between about 15 pounds to about 25 pounds of weights. The weights may be provided in a single unit, or in two or more units. In one or more embodiments, the weights are provided in about 5 pound units and/or about 10 pound units. The weights may be color coded based on weight.

Figure 2:
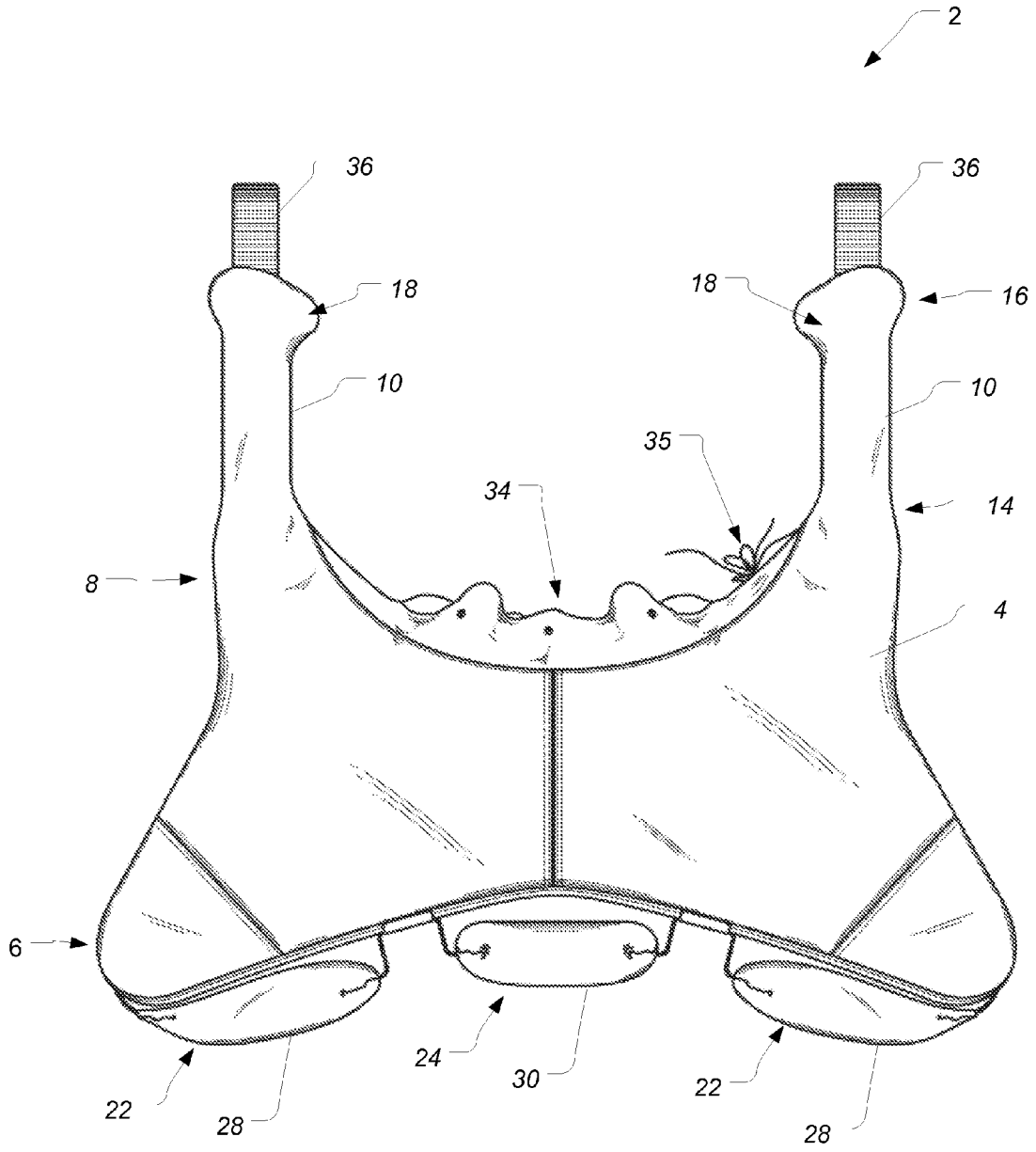
FIG. 2 illustrates a back view of an exemplary multi-exercise device in accordance with one or more embodiments of a multi-exercise device.

FIG. 2 illustrates a back view of an exemplary multi-exercise device in accordance with one or more embodiments of a multi-exercise device. A back view of the embodiment of FIG. 1 is shown.

Figure 3:
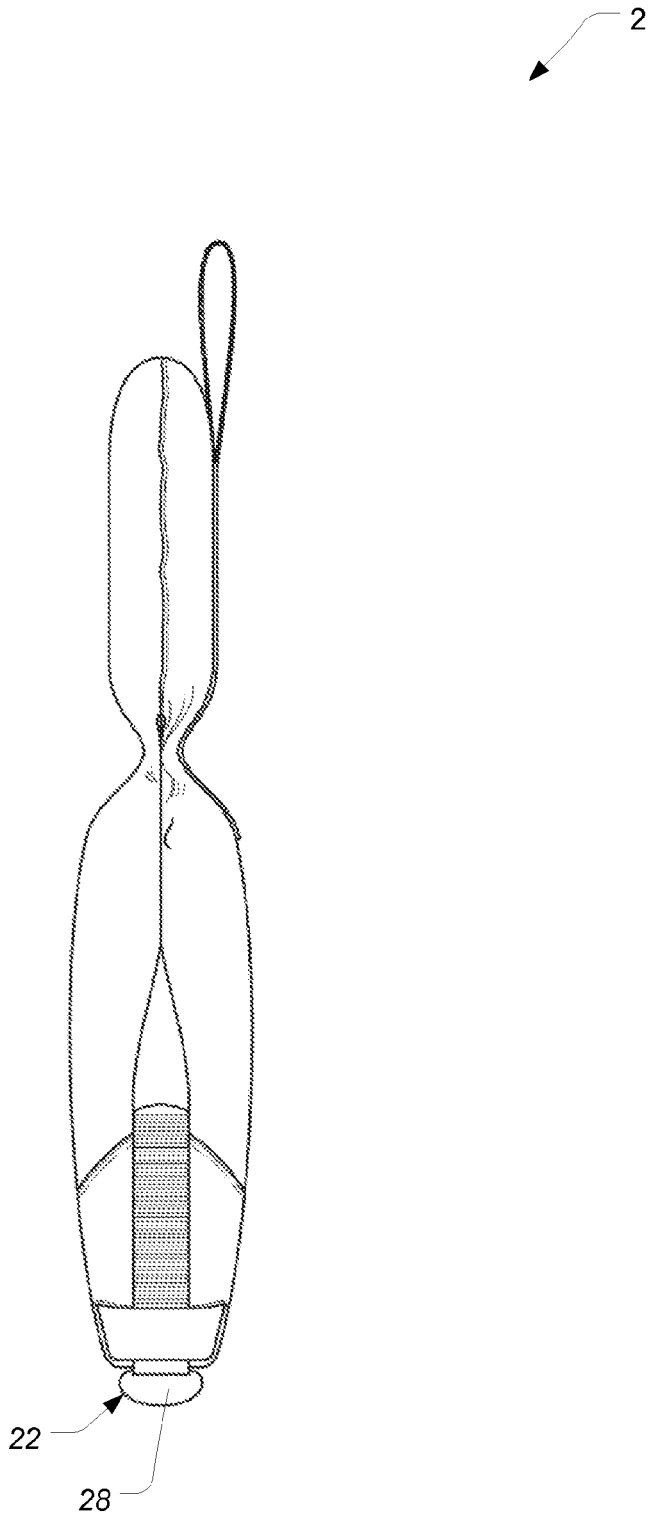
FIG. 3 illustrates a side view of an exemplary multi-exercise device in accordance with one or more embodiments of a multi-exercise device.

FIG. 3 illustrates a side view of an exemplary multi-exercise device in accordance with one or more embodiments of a multi-exercise device. A side view of the embodiment of FIG. 1 is shown.

Figure 4:
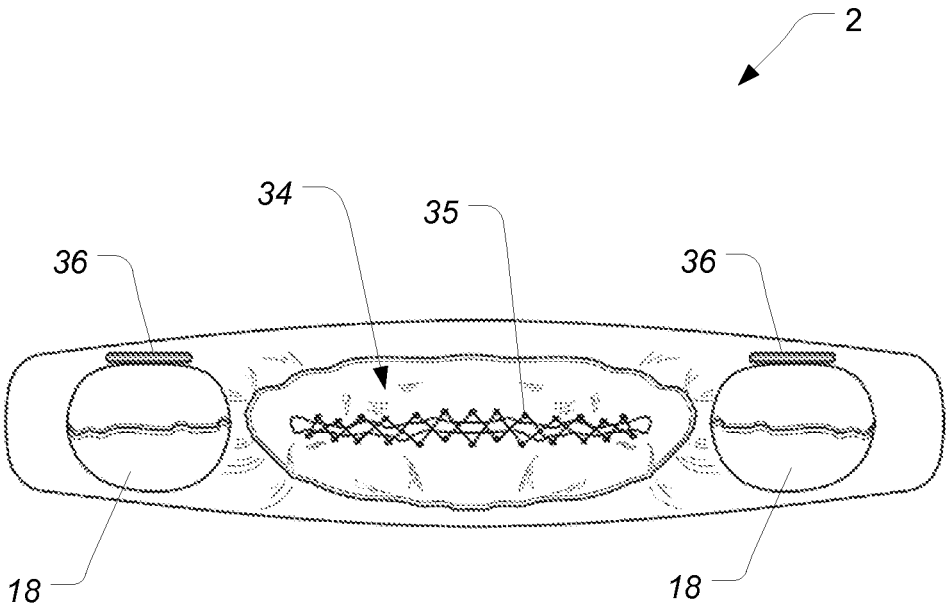
FIG. 4 illustrates a top view of an exemplary multi-exercise device in accordance with one or more embodiments of a multi-exercise device.

FIG. 4 illustrates a top view of an exemplary multi-exercise device in accordance with one or more embodiments of a multi-exercise device. A top view of the embodiment of FIG. 1 is shown.

Figure 5:
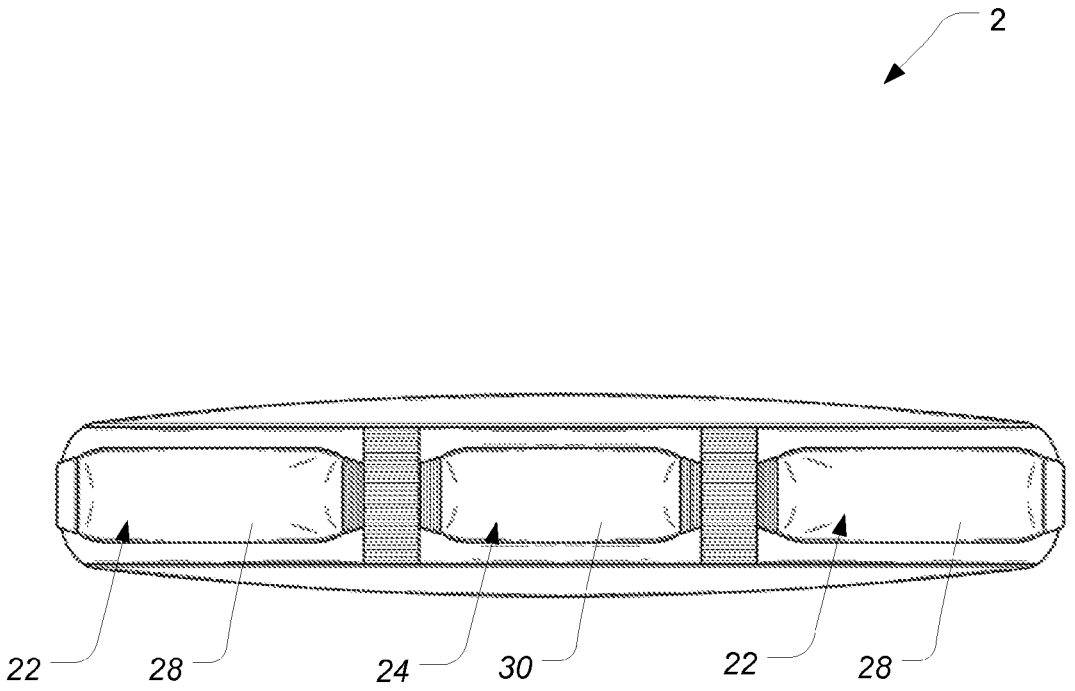
FIG. 5 illustrates a bottom view of an exemplary multi-exercise device in accordance with one or more embodiments of a multi-exercise device.

FIG. 5 illustrates a bottom view of an exemplary multi-exercise device in accordance with one or more embodiments of a multi-exercise device. A bottom view of the embodiment of FIG. 1 is shown.

Figure 6:
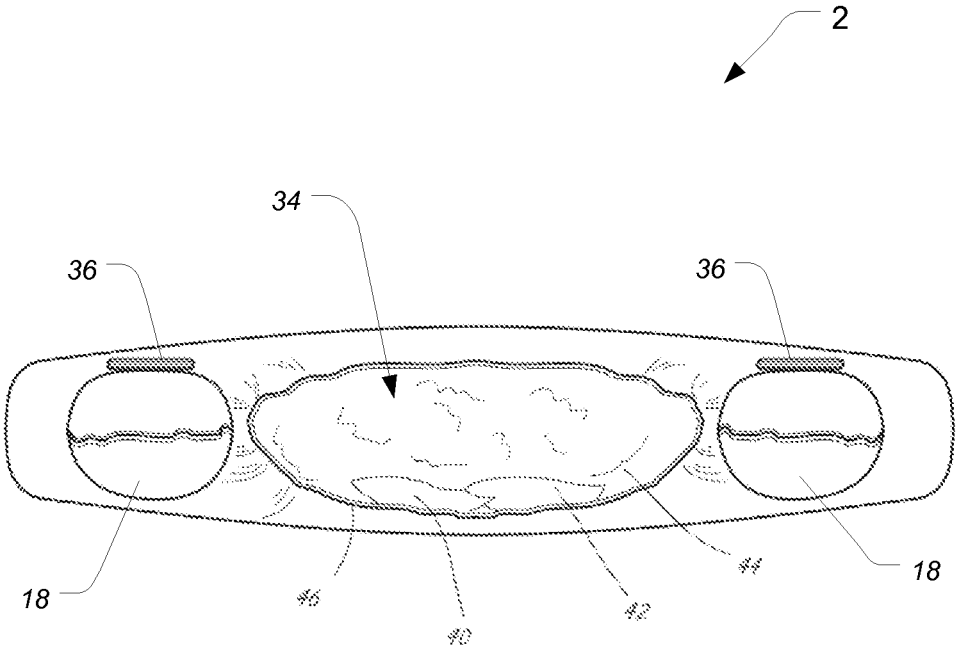
FIG. 6 illustrates an open view of the sealable opening of the exemplary multi-exercise device in accordance with one or more embodiments of a multi-exercise device.

FIG. 6 illustrates an open view of the sealable opening of the exemplary multi-exercise device in accordance with one or more embodiments of a multi-exercise device. Device body 4 of multi-exercise device 2 includes sealable opening 34. Sealable opening 34 may include a fastener 35, e.g. a zipper, a lacing system, buttons, clasps, connectors, or any other method suitable for providing a sealable opening.

Device body 4 may include shell 46 filled with padding material 44. Shell 46 may be made of rubber, leather, vinyl, canvas, nylon, any other fabric, or any other suitable material. Padding material 44 may be a fibrous padding material, including but not limited to cotton, synthetic fibers, shredded fabric, shredded material, foam, styrofoam, or any other suitable padding material.

In one or more embodiments, multi-exercise device 2 includes at least one weight 40-42 disposed inside device body 4. Alternatively, a removable weight may be disposable inside multi-exercise device 2. Device body 4 may include at least one securing device configured to secure the at least one weight inside of device body 4. In one or more embodiments, at least one weight 40-42 is simply placed inside of device body 4. Weight 40-42 may be held in place by padding material 44. In one or more embodiments, one or more straps, pockets, clasps, bands, fasteners, or any other securing device is used to further secure weight 40-42 inside of device body 4. In one or more embodiments, weight 40-42 includes a covering filled with a weighted material. Weight 40-42 may include steel, lead, tungsten, bismuth, alloy, iron, sand, water, liquid, shot, pellets, metal, or any other material suitable for a weight.

In one or more embodiments, a user may open sealable opening 34 to add and/or remove at least one weight 40-42. Device body 4 is configured to receive between about 5 pounds to about 50 pounds of weights, about 10 pounds to about 35 pounds of weights, and/or about 15 pounds to about 25 pounds of weights. Weights 40-42 may be provided in a single unit, or in two or more units. In one or more embodiments, weights 40-42 are provided in about 5 pound units and/or about 10 pound units. Weights 40-42 may be color coded based on weight.

Figure 8A:
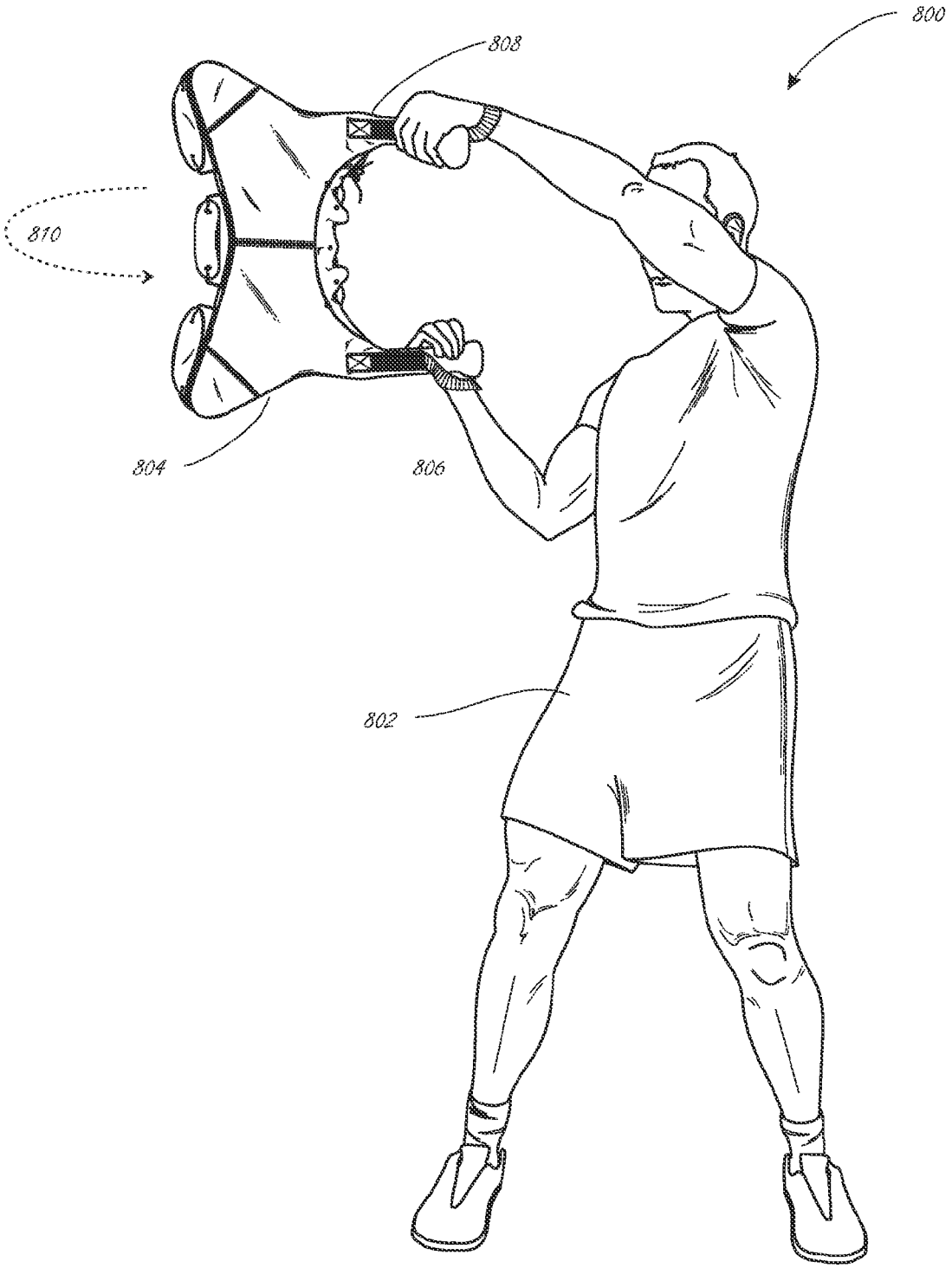
FIGS. 8A-8C illustrate exemplary exercise methods in accordance with one or more embodiments of a multi-exercise device.
Figure 8B:
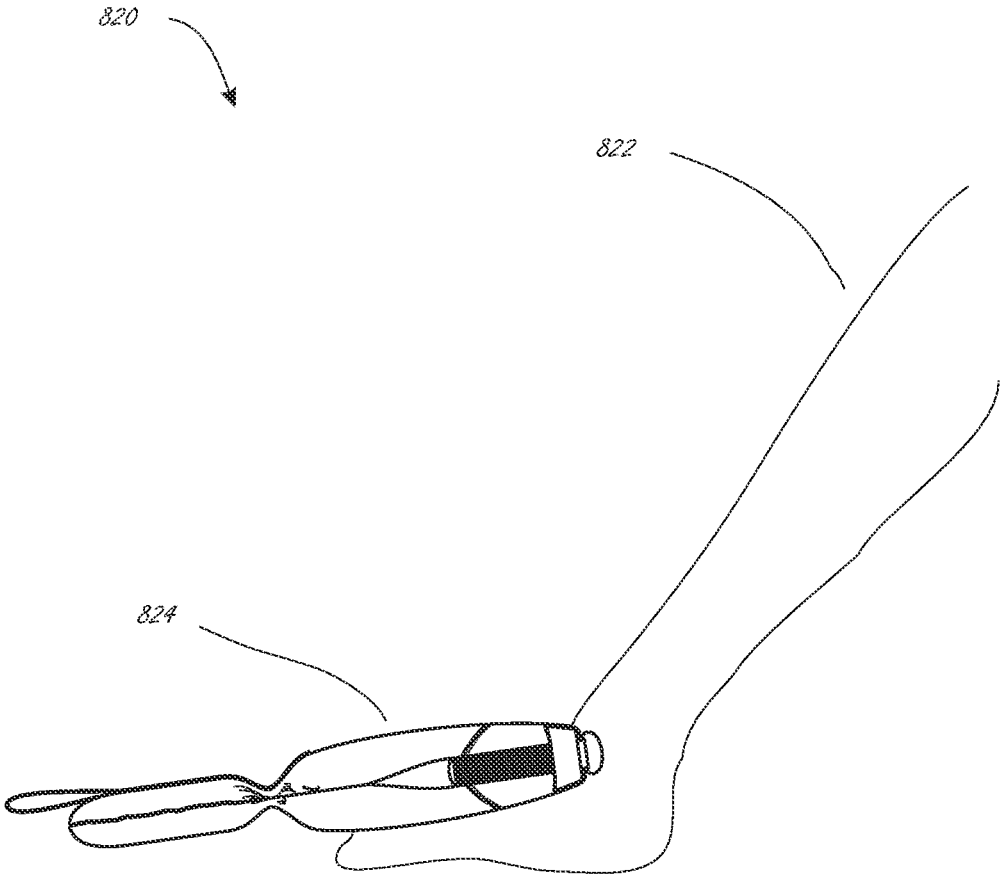
Figure 8C:
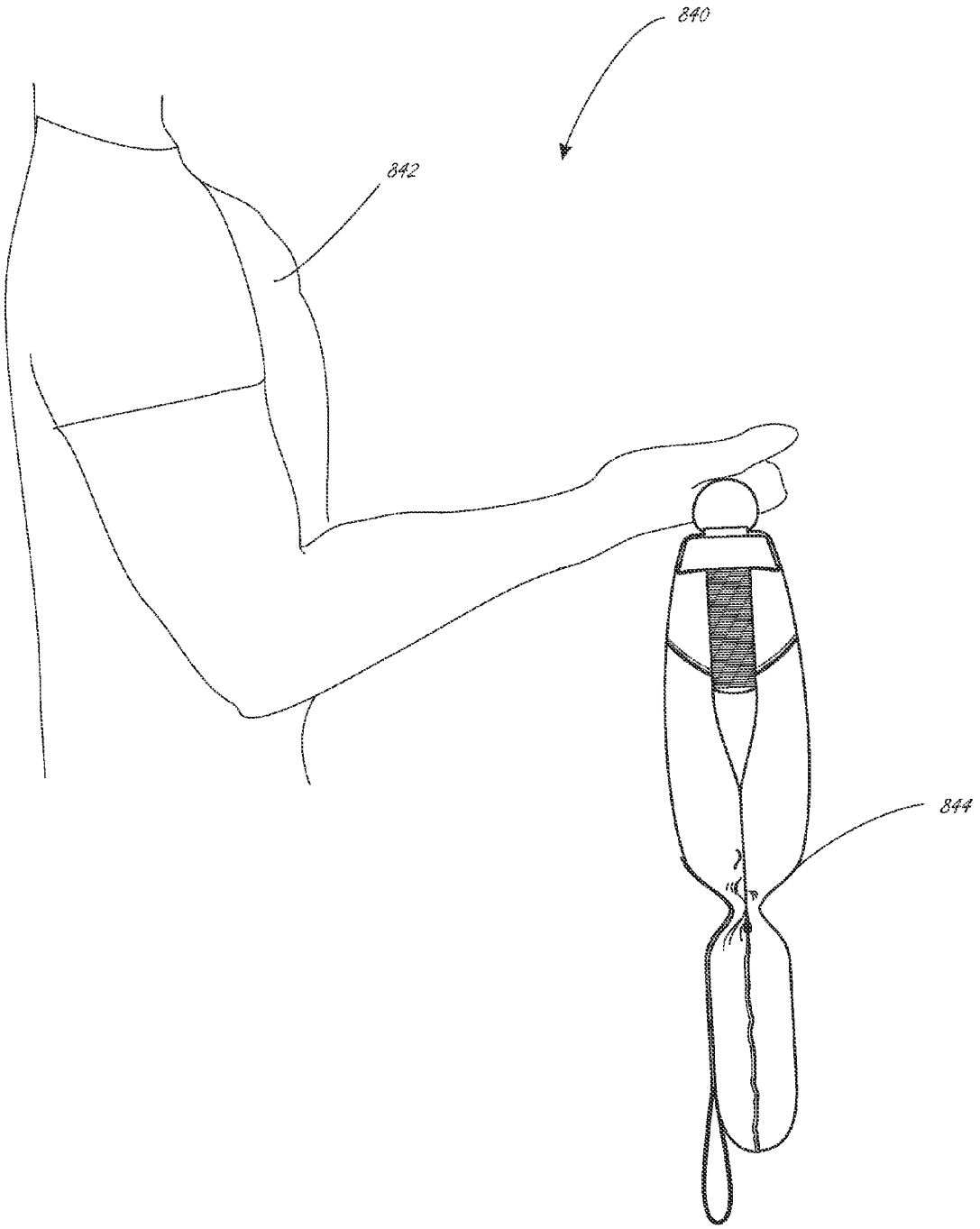

FIGS. 8A-8C illustrates exemplary exercise methods in accordance with one or more embodiments of a multi-exercise device.

FIG. 8A illustrates exercise 800. User 802 grabs extending handles 806-808 of multi-exercise device 804 with a left hand and a right hand. User 802 raises his arms are above shoulder level. User 802 moves his arms in a circular path to swing multi-exercise device 804 in a circular path 810. Multi-exercise device 804 may be swung clockwise as well as counter-clockwise. Exercise 800 engages the core muscles, including abdominal muscles, obliques and back muscles.

FIG. 8B illustrates exercise 820. User 822 places multi-exercise device 824 on one or more of the user's feet. At least one weight is disposed in multi-exercise device 824. User 822 performs at least one strength training exercise with multi-exercise device 824 in this position. Multi-exercise device 824 provide a counterbalance force such that user 822 can perform exercises traditionally performed with a partner to provide the counterbalance force. In one or more embodiments, exercise 820 is an abdominal strength exercise, including but not limited to sit ups and sit up variants.

FIG. 8C illustrates exercise 840. User 842 grabs at least one side handle or extending handle of multi-exercise device 844 with at least one hand and performs at least one weight-training exercise. In one or more embodiments, exercise 840 is a weight training exercise that engages one or more muscles of the arm or shoulder, such as deltoid, bicep, tricep, brachialis, brachioradialis, forearm flexors, wrist flexor, extensor, or any other arm muscles. Exercise 840 may also engage any other muscle, including but not limited to trapezius, infraspinatus, pectoral, glutes, quadriceps, calve, hamstring, abdominal, oblique, back or any other skeletal muscle. For example, exercise 840 may be selected from squats, lunges, curls, lifts, raises, abduction, adduction, presses, raises, extensions, and any other weight training exercise compatible with one or more embodiments of the multi-exercise device described herein.

While the invention herein disclosed has been described by means of specific embodiments and applications thereof, numerous modifications and variations could be made thereto by those skilled in the art without departing from the scope of the invention set forth in the claims.

What is claimed is:

1. A multi-exercise device comprising:

a device body comprising a first side and a second side disposed on opposite sides of said device body;

at least one weight receiving area disposed on an interior of said device body, wherein said at least one weight receiving area is configured to secure at least one weight inside of said device body;

at least one side handle coupled with said first side of said device body;

at least one hand grip disposed on each of said at least one side handle, wherein said hand grip is contoured for placement of a user's hand; and two extending handles, each comprising a proximal end and a distal end, wherein said proximal end of each of said two extending handles is coupled to said device body at opposing ends of said second side of said device body, wherein each of said two extending handles comprises a substantially cylindrical grip portion extending from said proximal end and joins with a circumferentially larger member that serves as a slip-prevention device at said distal end.

2. The multi-exercise device of claim 1, wherein said two extending handles are disposed near opposite ends of said second side of said device body.

3. The multi-exercise device of claim 1, wherein said distal end of each of said two extending handles comprises a widened portion for said slip prevention.

4. The multi-exercise device of claim 1, further comprising two security loops coupled with said device body.

5. The multi-exercise device of claim 4, wherein each of said two security loops is positioned adjacent to one of said two extending handles.

6. The multi-exercise device of claim 1, wherein said two extending handles extend from said second side by at least about 8 inches.

7. The multi-exercise device of claim 1, wherein said first side of said device body is longer than said second side of said device body.

8. The multi-exercise device of claim 1, wherein said device body is filled with a padding material.

9. The multi-exercise device of claim 8, wherein said padding material comprises a fibrous padding material.

10. The multi-exercise device of claim 1, further comprising said at least one weight.

11. The multi-exercise device of claim 10, wherein said at least one weight comprises sand.

12. The multi-exercise device of claim 1, wherein said device body comprises a sealable opening.

13. The multi-exercise device of claim 12, wherein said sealable opening comprises a lacing system.

14. The multi-exercise device of claim 1, wherein said at least one side handle and said two or more hand grips are positioned in a row along a length of said first side of said device body.

15. The multi-exercise device of claim 1, wherein said at least one side handle comprises two outer side handles.

16. The multi-exercise device of claim 15, wherein said at least one side handle further comprises a center side handle located between said two outer side handles.

17. The multi-exercise device of claim 1, wherein said at least one side handle comprises a single side handle comprising multiple hand grip positions, wherein said each of said multiple hand grip positions comprise said at least one hand grip.

18. A multi-exercise device comprising:

a device body comprising a first side and a second side disposed on opposite sides of said device body;

at least one weight receiving area disposed in an interior of said device body, wherein said at least one weight receiving area is configured to secure at least one weight inside of said device body;

a plurality of side handles coupled to said first side of said device body;

at least one hand grip disposed on each of said plurality of side handles, wherein each of said at least one hand grip is contoured for placement of a user's hand; and two extending handles, wherein a proximal end of each of said two extending handles is coupled at an opposing end of said second side, wherein each of said two extending handles comprises a grip portion extending from said proximal end and joins with a substantially larger non-grip portion at its distal end that serves as a slip-prevention device.

19. A multi-exercise device comprising:

a device body comprising a first side and a second side;

at least one weight receiving area disposed in an interior of said device body and having an access through said second side, wherein said at least one weight receiving area is configured to secure at least one weight inside of said device body;

three side handles coupled to said first side of said device body;

at least one hand grip disposed on each of said side handle, wherein each of said at least one hand grip is contoured for placement of a user's hand; and two extending handles filled with fibrous padding material, wherein a proximal end of each of said two extending handles is coupled to said device body at opposing ends of said second side, wherein each of said two extending handles comprises a grip portion extending from said proximal end and joins with a substantially larger non-grip portion at its distal end that serves as a slip-prevention device.

* * * * *